United States Patent [19]

Baranski

[11] Patent Number: 4,947,673

[45] Date of Patent: Aug. 14, 1990

[54] REMOVABLE SLIDE PRESSES

[75] Inventor: Robert Baranski, Chicago, Ill.

[73] Assignee: Connell Limited Partnership, Boston, Mass.

[21] Appl. No.: 337,314

[22] Filed: Apr. 13, 1989

[51] Int. Cl.[5] ..... B21D 37/10

[52] U.S. Cl. ..... 72/456; 72/446; 72/448; 72/455; 100/214; 100/918

[58] Field of Search ..... 72/455, 456, 446, 448; 100/214, 918

[56] References Cited

U.S. PATENT DOCUMENTS

| | | | |
|---|---|---|---|
| 769,597 | 9/1904 | Elam . | |
| 1,003,987 | 9/1911 | Cotton et al. . | |
| 1,311,367 | 7/1919 | Angier . | |
| 1,960,548 | 5/1934 | Pfeiffer . | |
| 1,977,549 | 10/1934 | Glasner . | |
| 2,475,692 | 7/1949 | Borzym . | |
| 2,532,320 | 12/1950 | Maussnest . | |
| 2,889,507 | 6/1959 | Kennedy et al. . | |
| 2,924,983 | 2/1960 | Curran . | |
| 2,976,832 | 3/1961 | Kennedy | 72/21 |
| 2,996,025 | 8/1961 | Georgeff . | |
| 3,111,100 | 11/1963 | Georgeff . | |
| 3,134,350 | 5/1964 | Danly et al. . | |
| 3,154,006 | 10/1964 | Novak . | |
| 3,207,065 | 9/1965 | Danly . | |
| 3,212,430 | 10/1965 | Clements . | |
| 3,225,686 | 12/1965 | Clements . | |
| 3,274,819 | 9/1966 | Knowles . | |
| 3,339,482 | 9/1967 | Jewett | 100/214 |
| 3,368,479 | 2/1968 | Gregorovich . | |
| 3,385,207 | 5/1968 | Opitz | 100/214 |
| 3,427,854 | 2/1969 | Michelson . | |
| 3,461,794 | 8/1969 | Schaeffer . | |
| 3,495,526 | 2/1970 | Mohler et al. . | |
| 3,559,522 | 2/1971 | Valente . | |
| 3,574,922 | 4/1971 | Eppich . | |
| 3,604,243 | 9/1971 | Muller . | |
| 3,668,921 | 6/1972 | Budman et al. . | |
| 3,702,560 | 11/1972 | Weidel . | |
| 3,704,974 | 12/1972 | Kostur . | |
| 3,719,445 | 3/1973 | Sindelar . | |
| 3,797,298 | 3/1974 | Vasilkovsky et al. . | |
| 3,942,431 | 3/1976 | Goff . | |
| 3,973,427 | 8/1976 | Shirao . | |
| 4,068,577 | 1/1978 | Murphy . | |
| 4,152,978 | 5/1979 | Abe et al. . | |
| 4,165,685 | 8/1979 | Nakada et al. . | |
| 4,206,699 | 6/1980 | Hemmelgarn . | |
| 4,238,950 | 12/1980 | Carrieri et al. . | |
| 4,274,332 | 6/1981 | Nakamura . | |
| 4,283,929 | 8/1981 | Heiberger . | |
| 4,318,295 | 3/1982 | Sindelar . | |
| 4,325,300 | 4/1982 | Fortier et al. . | |
| 4,354,374 | 10/1982 | Deguchi . | |
| 4,387,635 | 6/1983 | Abbestam et al. | 100/214 |
| 4,408,521 | 10/1983 | Schelli et al. . | |
| 4,408,522 | 10/1983 | Yamane . | |
| 4,442,691 | 4/1984 | Grow et al. . | |
| 4,552,050 | 11/1985 | Grefe . | |
| 4,571,979 | 2/1986 | Baba et al. . | |
| 4,630,536 | 12/1986 | Shah . | |
| 4,631,015 | 12/1986 | Shigeo et al. . | |
| 4,653,311 | 3/1987 | Tack, Jr. . | |
| 4,660,406 | 4/1987 | Rugh et al. . | |
| 4,691,554 | 9/1987 | Murphy . | |
| 4,693,448 | 9/1987 | Proksa et al. | 100/214 |
| 4,698,894 | 10/1987 | Lingaraju et al. . | |
| 4,714,421 | 12/1987 | D'Agostino . | |
| 4,744,036 | 5/1988 | Van Tiggelen . | |

FOREIGN PATENT DOCUMENTS

| | | | |
|---|---|---|---|
| 0212900 | 12/1983 | Japan | 100/214 |

*Primary Examiner*—David Jones

*Attorney, Agent, or Firm*—Leydig, Voit & Mayer

[57] ABSTRACT

Underdrive power presses are provided with arrangements where the slide mechanism is removable transversely through spaced apart hollow side uprights of the press frame. Pull rods extending from the press drive mechanism are located within the hollow uprights. Movable crossheads are slidably mounted with respect to the uprights above the slide and provide means in a dual action press for independently coupling an inner slide and outer slide within the opening between uprights. Since the slide connections are disposed beneath the movable crossheads and dimensioned narrower than the upright opening, the slide mechanism can be uncoupled and transversely moved outside of the press frame through an upright opening.

14 Claims, 10 Drawing Sheets

REMOVABLE SLIDE PRESSES

FIELD OF THE INVENTION

The present invention relates generally to power presses, and more particularly, to power presses having provision for efficiently and economically maintaining or repairing slide assemblies. In its principal aspect the invention is concerned with improved means for removing slides from the frame of underdrive presses.

BACKGROUND OF THE INVENTION

As power presses have continued to increase in size and capacity, the components of such presses have also increased both in size and weight, and are now so large and unwieldy that much time and energy must be expended when removal of these components is required. In order to reduce both the amount of down time for such a large press and also the cost of labor of the highly paid press workers during the changeover, manufacturers have long sought to simplify changeover procedures.

An exemplary and early innovation of this type is shown in Vasil Georgeff, U.S. Pat. No. 3,111,100, issued November 19, 1963, which was assigned to the assignee of the present invention. The Georgeff patent, entitled "Quick Die Change Press," solved an industry-wide dilemma providing the manufacturer with a power press wherein the press dies were changeable in a rapid, convenient, and expeditious manner. As a result of that improvement, press versatility and efficiency was substantially increased, while the excessively high labor costs incurred in changing the dies were significantly reduced.

In the disassembly of a power press, one of the most difficult and time consuming operations which must be performed is the removal of the slide mechanism for maintenance or repair. In a typical double action press there are two slide mechanisms, an inner slide and an outer slide or blankholder, these slide mechanisms are of such construction that they cannot normally be removed through the press uprights. Accordingly, the labor costs associated with this removal procedure are quite high, and due to the size and weight of the slide mechanisms, considerable precautions are necessary so as not to expose workers to significant danger.

In a conventional underdrive press, the pull rods connect directly to a connecting adjusting mechanism mounted on the upper surface of the slide below the crown. Typically, the crown is of considerable size and weight and is located at a substantial distance above the pressroom floor. Accordingly, the use of an overhead crane is required in order to perform the changeover procedure. And, since the slide mechanisms cannot be simply removed through the press uprights, the crane must also be used to lift the slide mechanism out from between the uprights. Such a method of slide removal results in excessive down time and cost, and potentially poses dangers within the pressroom.

Furthermore, conventional double action presses are designed such that the inner slide is guided within the blankholder. Accordingly, removal of the slides first requires disconnecting the pull rods and then lifting the slides from between the uprights. In conventional presses, the pull rods and crossheads are disposed within the press uprights, and due to the requirement that the inner slide be guided within the blankholder, the pull rods and crossheads occupy a substantial portion of the upright interior. Presses have not been heretofore constructed where a press has allowed for the removal of an assembled slide mechanism through the uprights.

Accordingly, it is an object of the present invention to provide a power press wherein the slides are transversely removable through the uprights without requiring disassembly of the press frame or slide mechanisms.

Furthermore, it is an object of the present invention to provide a power press wherein the inner slide and blankholder are independently guided by fully adjustable gibbing on the press uprights.

It is a further object of the invention to provide improved means for removing the slides from the frame of an underdrive press.

Yet another object of the invention is to provide a power press wherein the slides may be removed in a safe, expeditious and efficient manner.

SUMMARY OF THE INVENTION

In general, the present invention contemplates a power press in which the slides are removable transversely through the space between the uprights thereof for purposes of maintenance or repair. By providing a press wherein the uprights are spaced apart allowing for removal of an assembled slide mechanism therethrough, the maintenance and repair procedures are more safely and efficiently completed.

To provide an opening of sufficient size for removal of the slides, the pull rods are located in an area substantially within the hollow uprights. And, in order to eliminate direct connection of the pull rods to the slides within the uprights, movable crossheads are provided above the slide to which the pull rods are connected. The crossheads are located above the slides and impart reciprocating motion to the slides. The incorporation of the movable crossheads into the power press above the slides further allows for the independent coupling of the inner slide and blankholder to their respective crossheads. As the crossheads span the opening between the uprights, the slide connections can be located in an area within the upright opening allowing construction of a slide which is narrower in its front to back dimensions and thus removable through the area between the front and back uprights.

BRIEF DESCRIPTION OF THE DRAWINGS

For the purpose of facilitating an understanding of the invention, the accompanying drawings illustrate a preferred embodiment. The above and other objects of the invention, as well as the features thereof as summarized above, will become more apparent from the following description when taken in conjunction with the accompanying drawings.

DESCRIPTION OF THE PREFERRED EMBODIMENT

Figure 1:
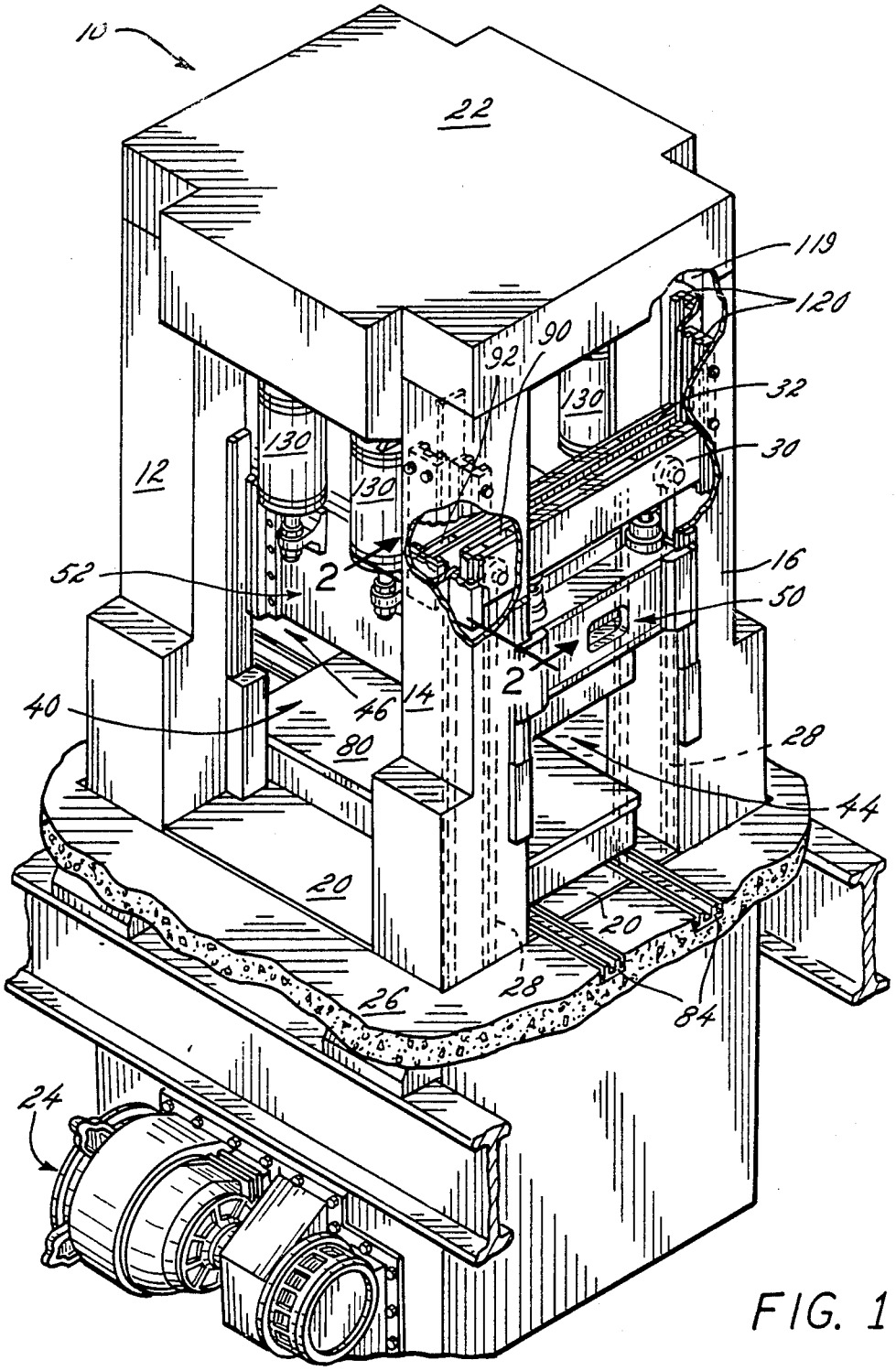
FIG. 1 is a perspective view of a power press in accordance with the present invention showing a slide mechanism which is transversely removable through the uprights thereof.
Figure 2:
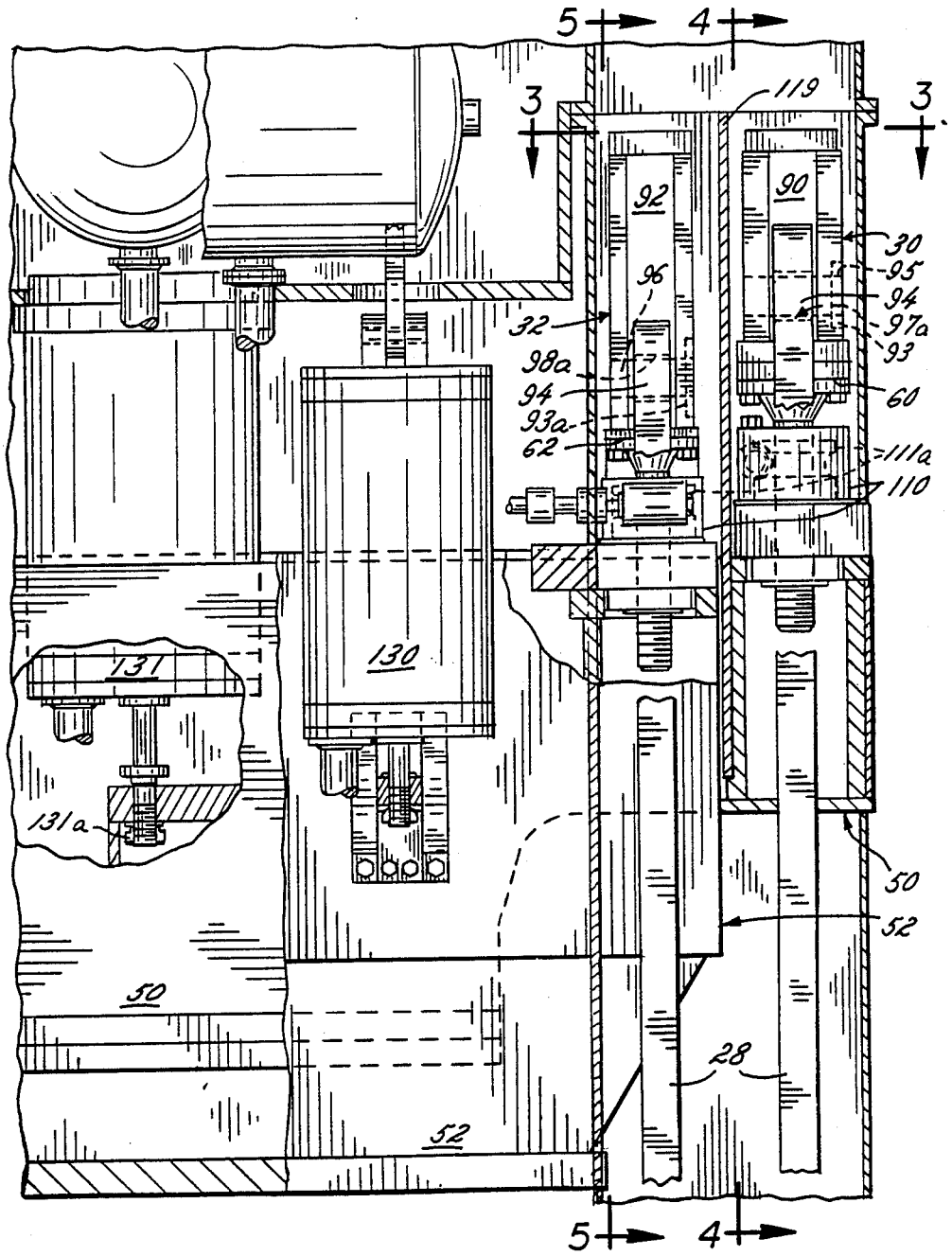
FIG. 2 is an enlarged front view of the right portion of the press of FIG. 1, partially in section, taken generally along line 2—2 in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Turning now to the drawings, and first to FIG. 1, there is shown a power press 10 having four uprights, three of which are seen and indicated at 12, 14, and 16 extending from the press bed 20 to the crown 22 of the press. Guided by the plurality of uprights is an inner slide mechanism generally indicated at 50, which in operation, is reciprocated vertically toward and away from the press bed so as to bring a die into and out of contact with a work piece.

The press 10 is powered by a large motor and flywheel arrangement 24, preferably located in an area substantially beneath the press room floor 26. Preferably, a clutch and brake interlock mechanism is mounted axially on the flywheel and is adapted to arrest the movement of the slide mechanism 50. Power is delivered to the outer slide mechanism or blankholder 52 through a series of pull rods 28, pivotably connected to a pair of crossheads 30 and 32 in a manner known to the art. Preferably, a driving assembly such as conventional dual action drive means will be used to transfer the power developed by the motor and flywheel arrangement 24 to the slide mechanisms 50 and 52.

As shown in the drawings, uprights 12, 14, 16 and 18 (not shown) are, in fact, hollow columns, designed in such a manner so that the pull rods 28 can extend therethrough. In keeping with a major inventive aspect of the invention, the uprights and pull rods have been located so as to form an opening through which the slide mechanisms 50 and 52 can be removed from the press simply by removal of the gibs on one end of the inner slide and the four gibs on the outer slide. Uprights 12 and 14 are spaced so as to form a front press opening 40 through which a workpiece may be fed into the press directly beneath the slide mechanism 50 to be worked upon thereby. Similarly, uprights 16 and 18 (not shown) have been spaced apart such that a corresponding rear opening 42 (not shown) is created so that the formed workpiece may be removed from the press, thereby vacating the press work area and allowing an unformed workpiece to be simultaneously inserted through the front opening 40. With the incorporation of an automatic feeding system, such as that disclosed in U.S. Pat. No. 4,378,592 to Heiberger, assigned to the same assignee as the present invention, the press 10 can be incorporated into a synchronized line of presses, thereby providing the manufacturer with a fully automated and continuous production operation.

In keeping with the invention, uprights 14 and 16, and uprights 12 and 18 (not shown), have been spaced apart to form corresponding side openings 44 and 46. The uprights have been spaced such that the height and width dimensions of the opening, that is, the space between the uprights, is greater than the corresponding width and height dimensions of the slide mechanisms 50 and 52, thus allowing for the removal of the disconnected slide mechanisms transversely through either opening 44 or 46.

To further simplify the removal of the slide mechanisms 50 and 52, a conventional carrier 80 is utilized which is easily movable upon guide rails 84, the rails extending from the press bed 20 for a distance outward of the press, as viewed in the drawings. Preferably, the carrier will be capable of withstanding the substantial size and weight of the slide mechanisms, while requiring only minimal effort from the operator to remove the slide mechanism transversely through either opening 44 or 46. An exemplary carrier of this type is shown in U.S. Pat. No. 4,630,536, issued December 23, 1986, to Chandrakant K. Shah and assigned to the same assignee as the present invention.

In keeping with another feature of the present invention, movable crossheads 30, 30′ (not shown), 32 and 32′ (not shown) are slidably mounted in uprights 14, 16, 17 and 18 (not shown), providing a means for removably coupling the slide mechanism 50 within the press 10. As the pull rods 28 are pivotally connected to the crossheads 28, the reciprocal motion imparted by the motor and flywheel arrangement 24 is directly conveyed through the crossheads 30, 30′, and 32 and 32′, to the slide mechanisms 50 and 52, thereby causing the reciprocation toward and away from the press bed 20. Furthermore, since the crossheads are disposed across the openings 44 and 46, there is unobstructed access to the mechanism which couples the crossheads to the slide mechanisms.

As shown in the drawings, the movable crossheads are disposed across the side openings 44 and 46 above the slide, and are of such length as to span the distance between the hollow uprights. Incorporated into each of the hollow uprights 12, 14, 16 and 18 (not shown), is a separating wall 119, which not only serves to provide added stability to the upright, but further serves as a mounting surface for a plurality of guide columns 120. These guide columns are welded within the hollow columns, in paired arrangement, such that a guide column is located at each end of the crossheads 30 and 32. The guide columns 120 are engaged by a corresponding guide flange 33 disposed upon the ends of the crossheads 30 and 32 such that the crossheads are stabilized as they are reciprocated through a predetermined range of motion. Additionally, the guide columns 120 are fitted with adjustable steel gib plates 122. Bronze wear strips 123 are mounted on the gib plates which serve to reduce the friction between the guide flange surface of the crosshead and the guide column, thereby increasing the durability and wear life of the press 10.

Figure 8:
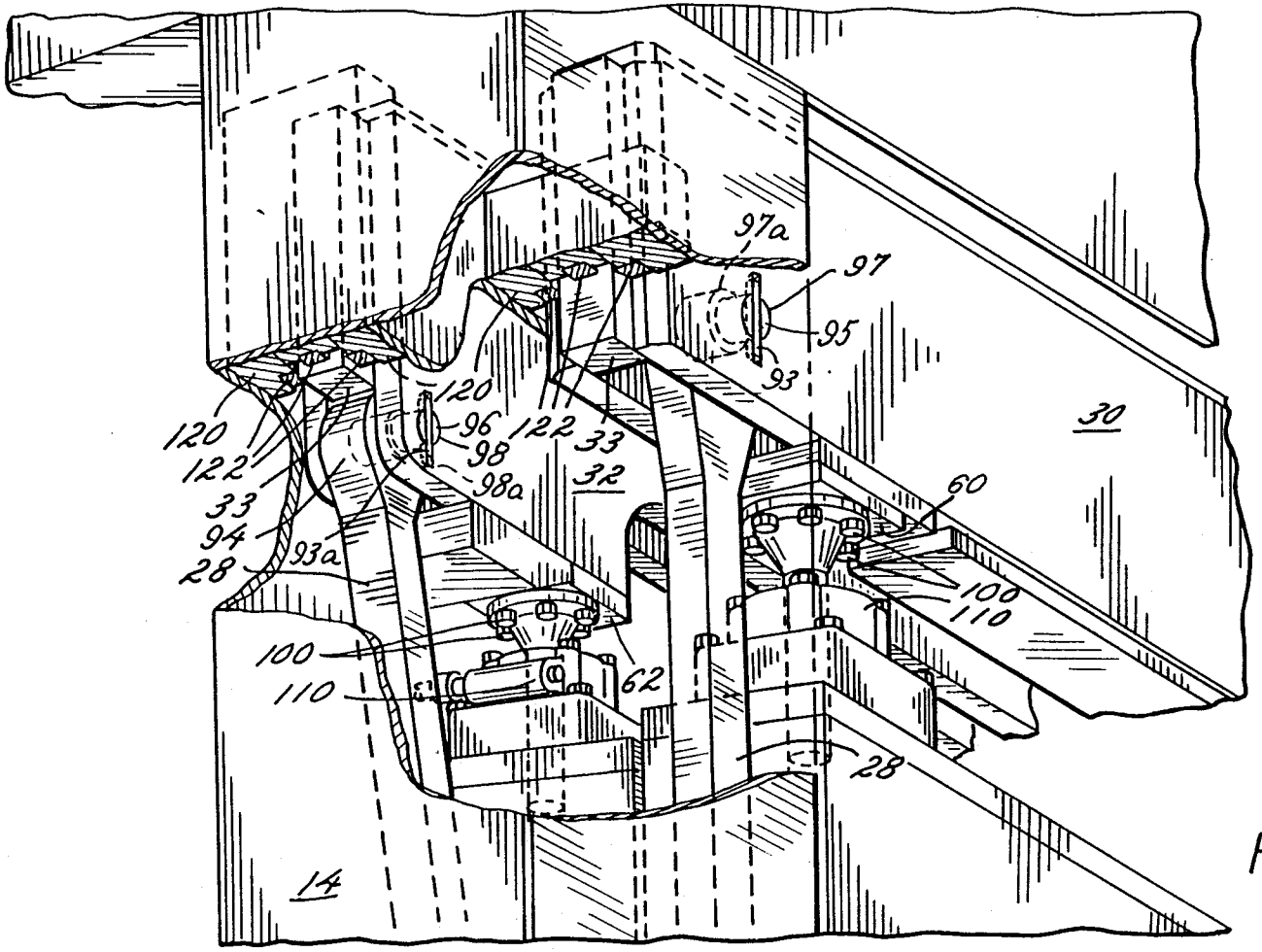
FIG. 8 is a perspective view of a power press similar to FIG. 1, but here having a portion broken away to show the crosshead structure.
Figure 9:
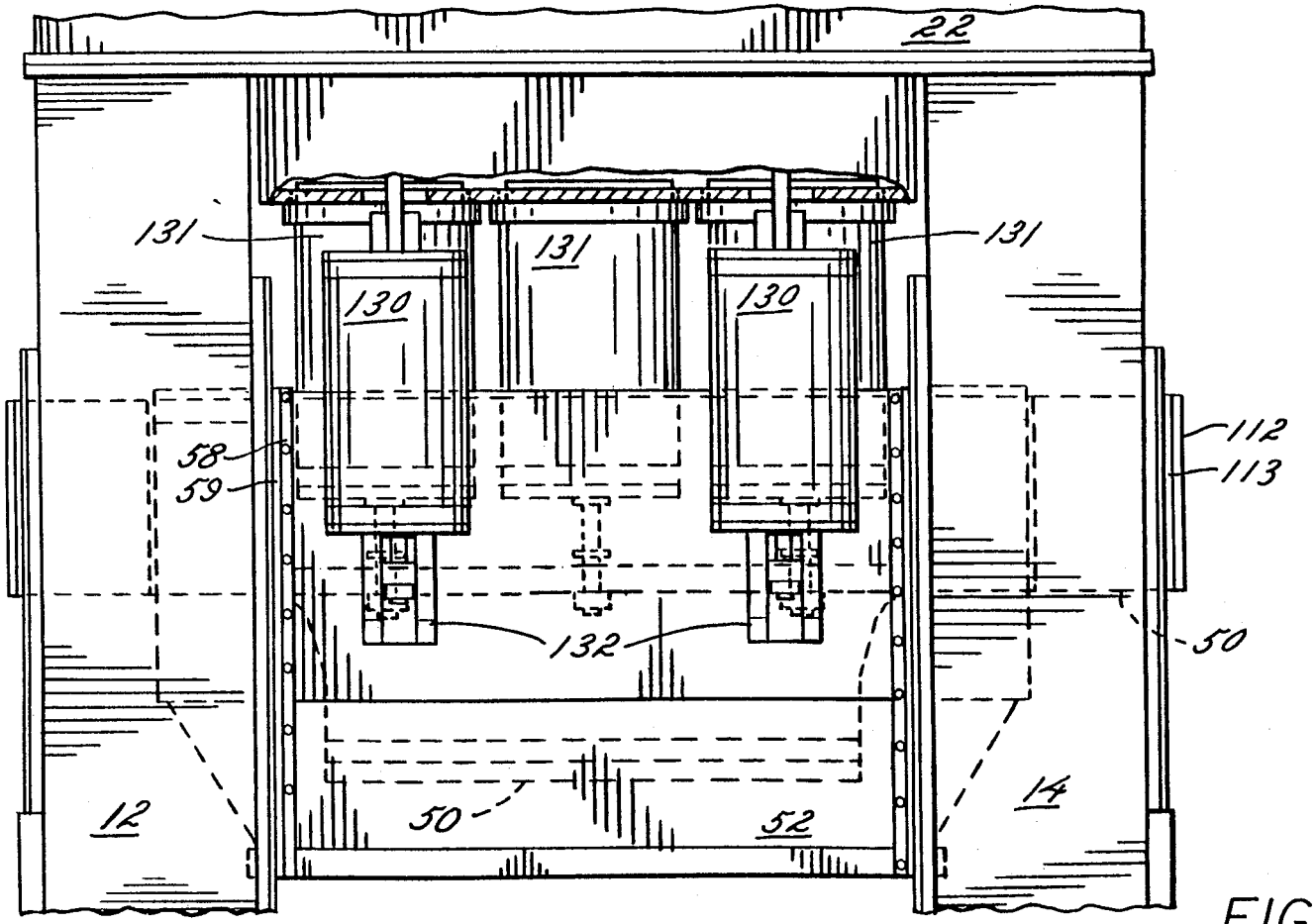
FIG. 9 is an enlarged front view of the press of FIG. 1.

Referring now to FIG. 8, the movable crossheads 30 and 32 are shown disposed within upright 14 and are engaged within the gib plates 122. Preferably, the crossheads will be constructed of welded steel plate, however, it is appreciated that casting procedures can also be utilized in order to form the body structure. Integrally formed within the crosshead are a pair of cavities 90 and 92, the cavities designed to receive the engaging end 94 of the pull rods 28. In order to provide a wear resistant surface and to further provide stability as the pull rods reciprocate through a motion cycle, bushings 97*a* and 98*a* are disposed within the engaging ends of the rods 28. The engagement cavities 90 and 92 are further designed such that the pivoting motion of the pull rod 28 is not obstructed by the crossheads 30 and 32 as the press is reciprocated through its motion cycle (see FIGS. 4 and 5). It will be appreciated, as shown in FIG. 1 and 8, that each crosshead is pivotally connected to two wrist pins 95 and 95' (not shown), and 96 and 96' (not shown), and is keyed in place by keys 93 and 93*a*, the connections extending through engagement cavities 90, 90' (not shown), 92 and 92' (not shown), disposed at opposite ends of each of the crossheads 30, 30' (not shown), 32, 32' (not shown).

In furtherance of the present invention, respective crossheads 30 and 32 are provided with mounting surfaces 60 and 62 for mounting adjusting screws 111 removably coupling the slides 50 and 52 thereto through threaded engagement with the adjusting nuts 111*a* connections 110. The mounting surfaces 60 and 62 have been provided with threaded bores adapted for receiving threaded fasteners 100 which mount the slide adjusting screws 111 to the respective crossheads 30 and 32 for threaded engagement with the adjusting nut 111*a* mounted on the slide. It will be appreciated from the drawings that in the preferred embodiment of the present invention, two slide adjusting screws and accordingly, two corresponding mounting surfaces are provided for each crosshead, thereby ensuring balanced, unskewed motion of the slide as it reciprocates through its motion range. Preferably, the slide connection 110 will incorporate features commonly known in the art such as a built-in worm drive adjusting mechanism, and a hydraulic overload feature which serves to prevent damage to the press in case of an accidental overload.

Figure 7:
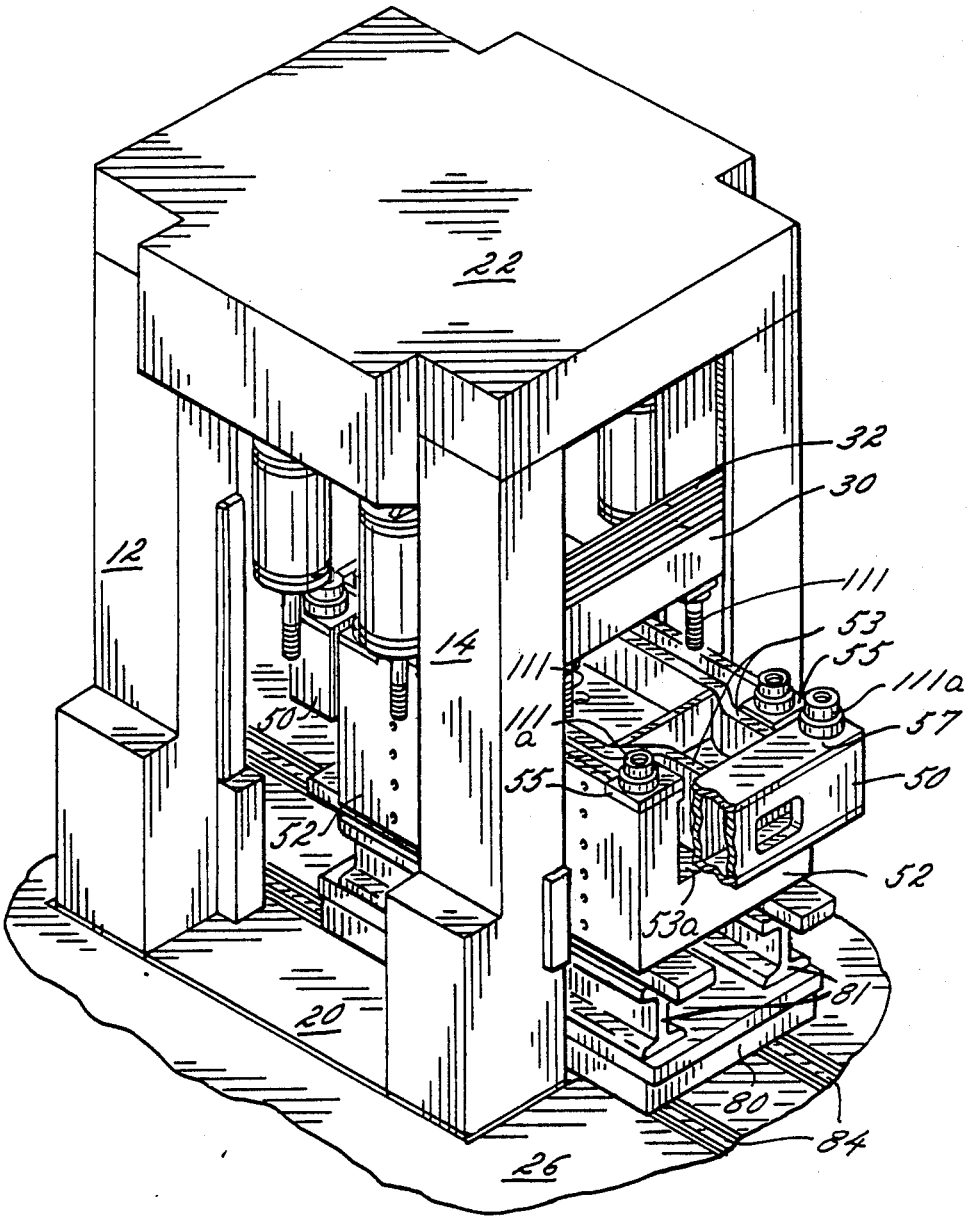
FIG. 7 is a perspective view of a power press similar to FIG. 1, but here illustrating a removal stage of the slide mechanism.

In further keeping with the invention, the press 10 is a double action press, provided with an inner slide 50 and an outer slide (blankholder) 52. In operation, the outer slide 52 is lowered into contact with a workpiece and retains it in position while the inner slide 50 performs the deformation procedure. As shown in FIG. 7, the blankholder 52 and inner slide 50 are positioned in conventional relation, that is, the blankholder 52 forms an outer perimeter in which the inner slide 50 is disposed. Accordingly, the blankholder 52 and inner slide 50 are independently movable through a predescribed motion cycle.

Figure 3:
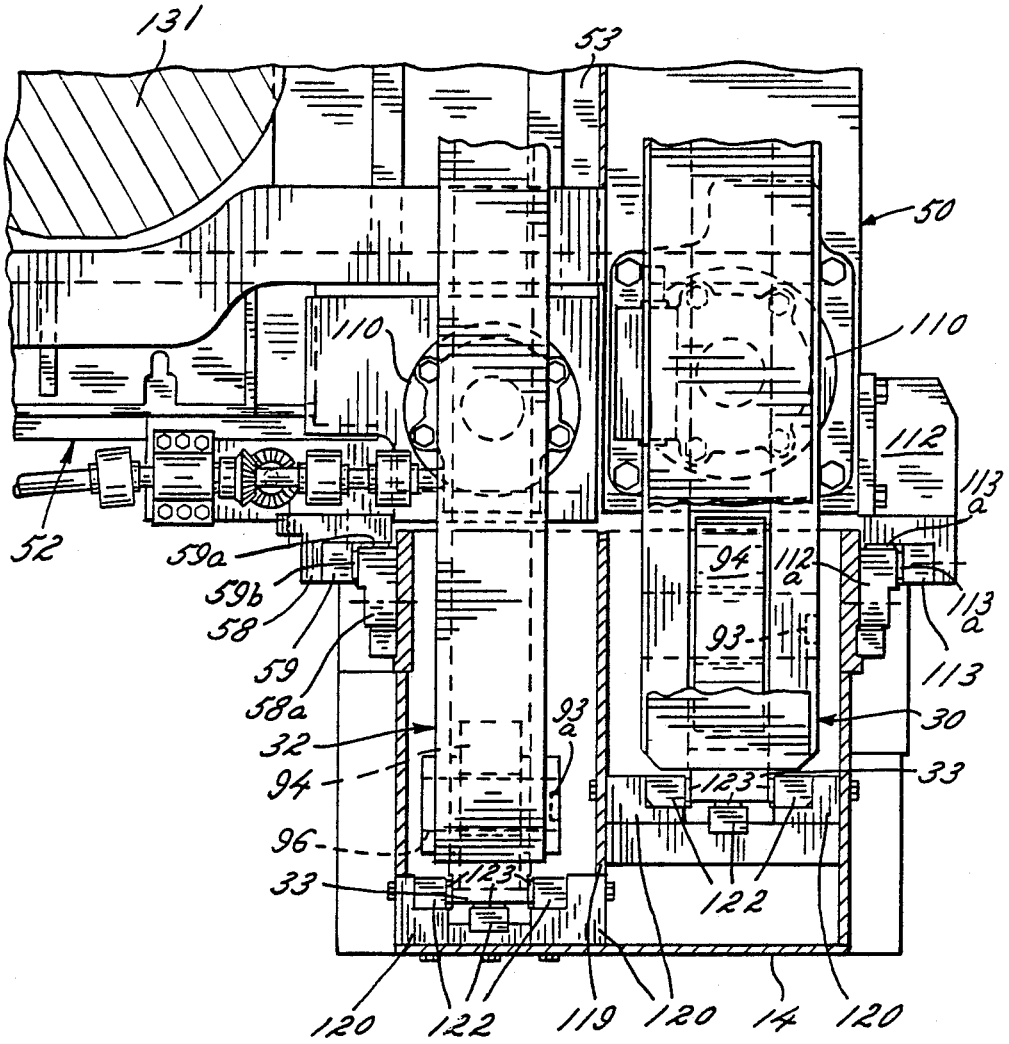
FIG. 3 is an enlarged top view taken generally along line 3—3 in FIG. 2.

In accordance with a primary object of the present invention, the blankholder 54 and inner slide 52 are separately guided by the gib and wear strip arrangement on the slides and uprights as disclosed in FIG. 3. As shown in FIG. 7, the inner slide 50 is provided with a frame extention 53 which spans the distance from the slide body to the appropriate corresponding crosshead. In accordance with the preferred embodiment of the present invention, the blankholder 52 is designed for connection with the innermost crosshead, the crosshead characterized as crosshead 32. The outer slide is provided with a mounting surface 55 which essentially consists of a machine area disposed on each of the four outer corners thereof. These plates are designed to serve as a mounting means for the outer slide connections 110 including adjusting nut 111*a*, and are disposed in vertical alignment with adjusting screws 110 mounted on crosshead 32 and 32' (not shown) for engagement therewith. As disclosed in FIG. 5, the crosshead 32 has a narrowed body section 35, best shown in FIG. 5, such that when the outer slide 52 is lowered into contact with the workpiece, the crosshead does not come into contact with the frame extension of the inner slide 50, which does not move down simultaneously with the outer slide, to be discussed herein. Furthermore, it should be appreciated that due to the location of the pull rods 28, the crosshead 32 has a body section of greater length than that of crosshead 30.

As best shown in FIG. 7, the inner slide has been provided with a frame extension 53 which extends from the inner slide body, across a cutout 53*a* provided in the side plates of the outer slide 52, to a distance such that it is in vertical alignment with adjusting screws 111 mounted on crosshead 30 for attachment therewith. In accordance with the invention, the inner slide is provided with mounting surfaces 57 at the distal end of the frame extension 53 which serve as mounting surfaces for the inner slide connection 110 including adjusting nut 111*a*. It will be appreciated that the inner slide 50, as well as the outer slide 52, is provided with four mounting surfaces, accordingly forming a four point connection between the slides and crossheads, thus providing a very stable distribution of the press load.

In order to further provide stability of the outer slide and inner slide throughout the reciprocating cycle, the outer slide and inner slide are provided with a plurality of guides. In particular, the outer slide 52 is provided with removable guides 58 on which are mounted adjustable gibs 59 and wear strips 59*a*. Wear strips 59*b* are mounted on adjustable gib 59. Wear strips 59*a* and 59*b* further remain in slidable contact with adjustable gib 58*a*, said adjustable gib disposed upon the inner surfaces of the uprights. Accordingly, in order to facilitate removal of the outer slide 52 from within the press frame, guides 58, wear strips 59*a* and gibs 59, with the wear strips 59*a* attached thereto, must be removed.

Similarly, the inner slide has been provided with removable guides 112 on which are mounted wear strips 113*a* and adjustable gibs 113 on which are mounted wear strips 113*b*, the wear strips remaining in slidable contact with gib 112*a*. Upon disconnection of the slide from the crosshead, the wear strip 113*a*, gib 113 and guides 112 must be removed from at least one side of the press such that these structures do not serve as obstructions as the slides are removed transversely through either of the side openings 44 or 46.

Figure 4:
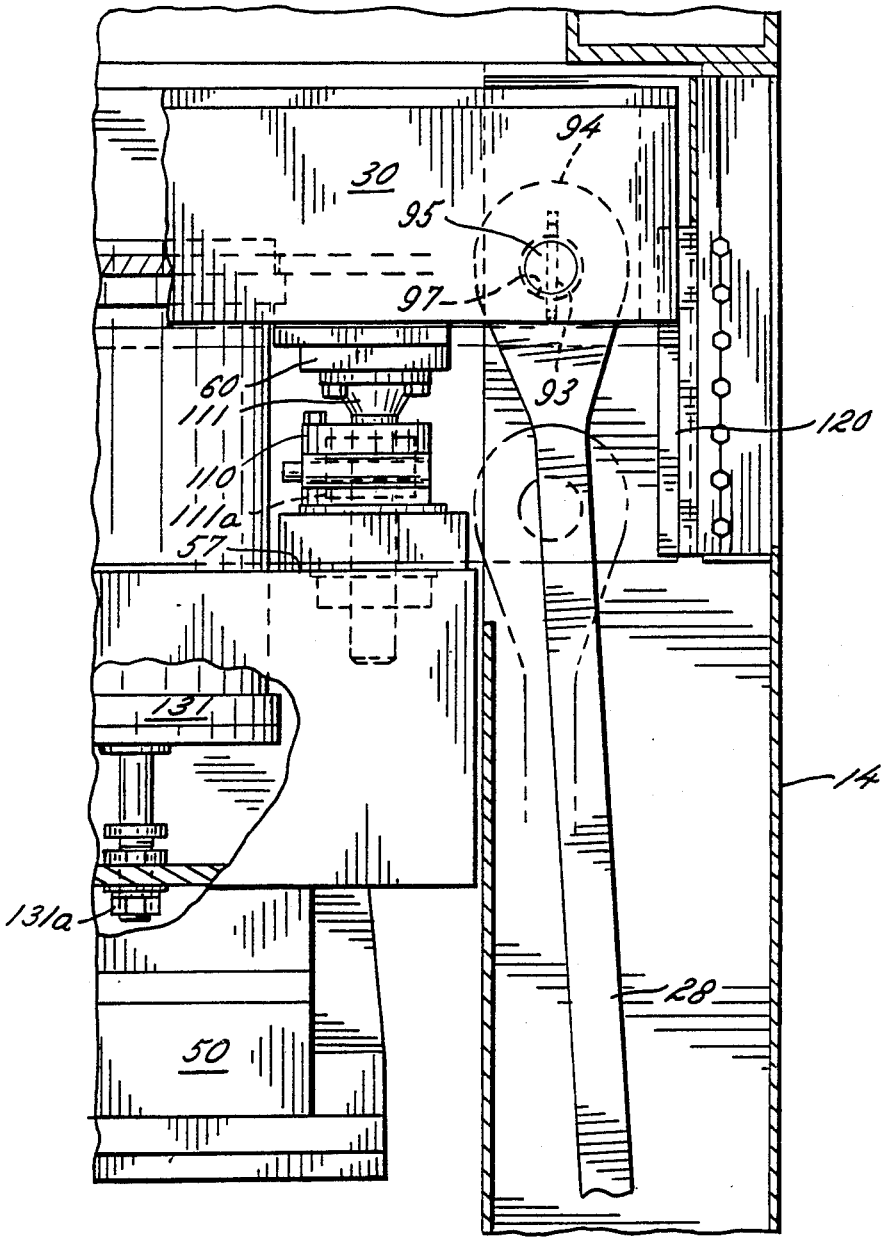
FIG. 4 is a section taken generally along line 4—4 in FIG. 2, on an enlarged scale.
Figure 5:
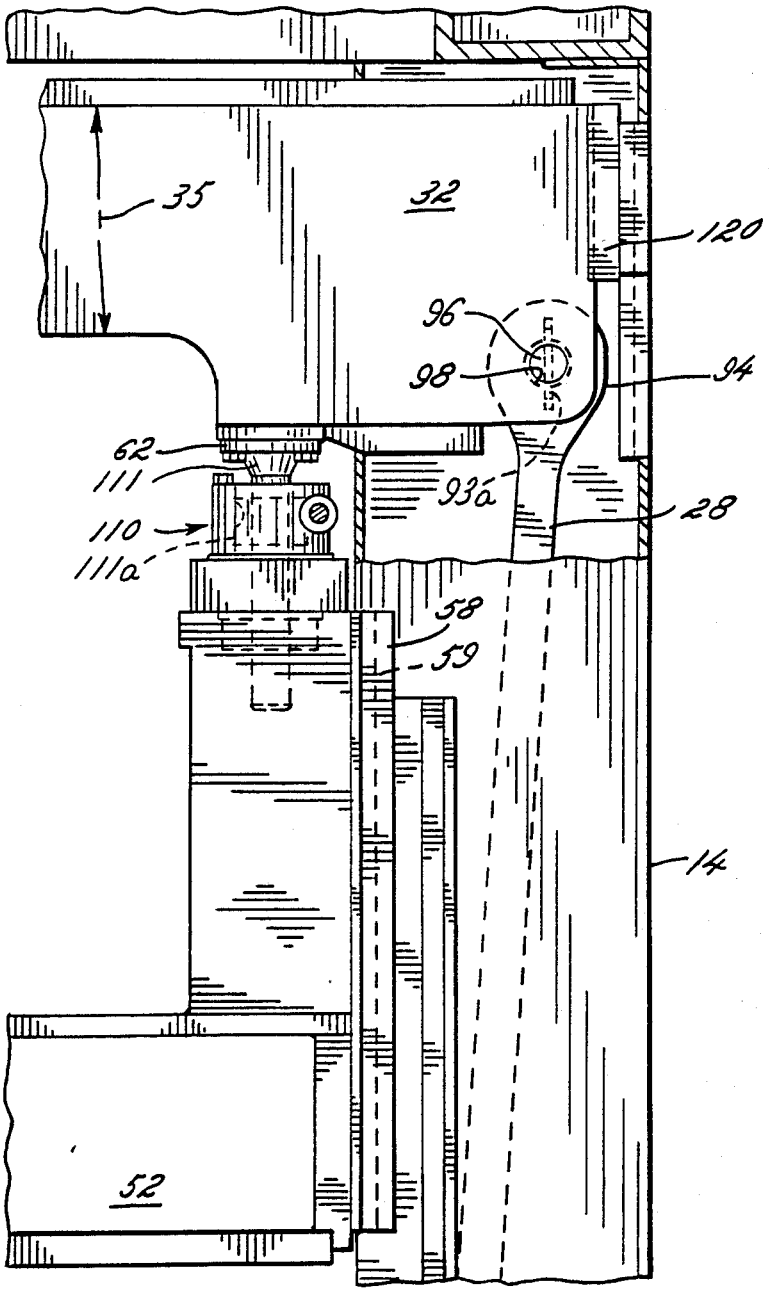
FIG. 5 is a section taken generally along line 5—5 in FIG. 2, on an enlarged scale.
Figure 6:
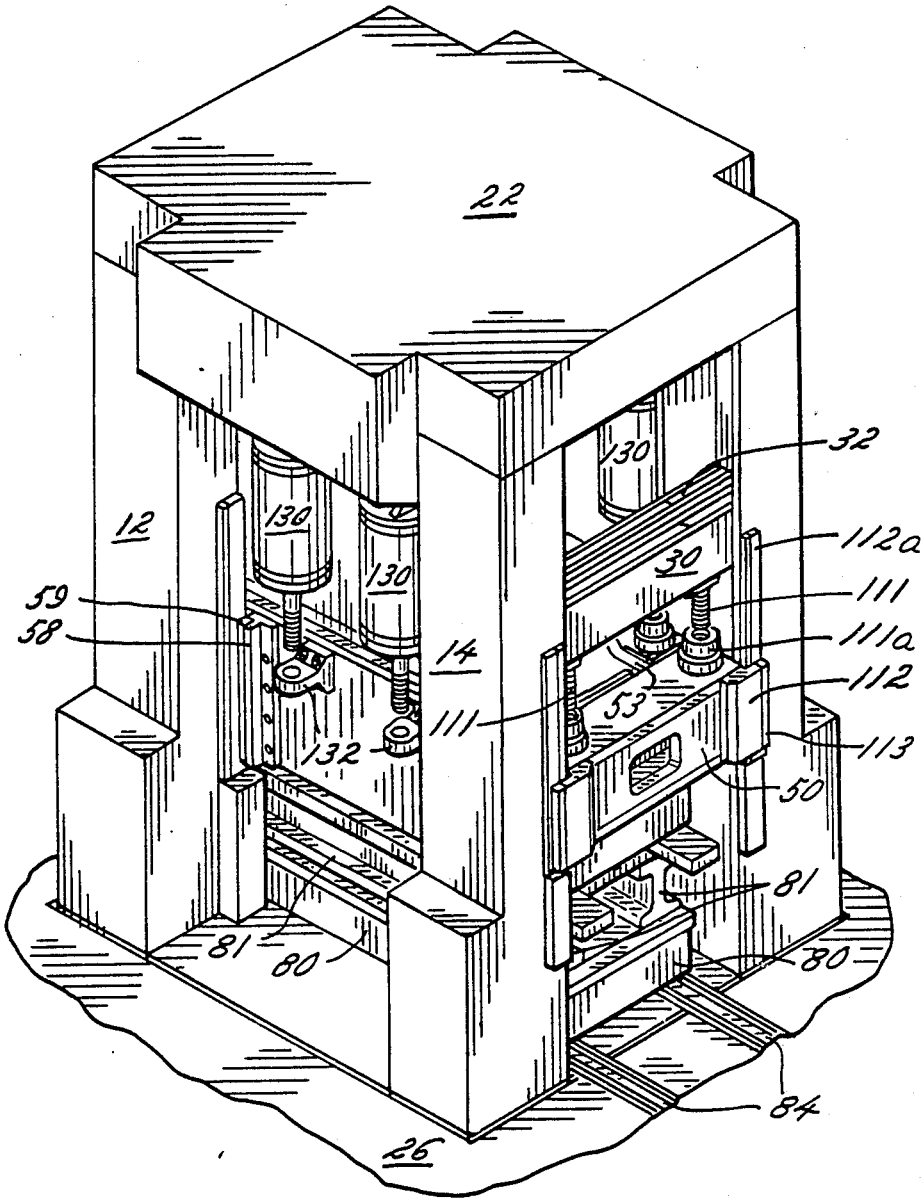
FIG. 6 is a perspective view of a power press having the slides disconnected from the press components.

Finally, in keeping with this invention, in order to remove the blankholder 52 and inner slide 50 from within the press 10, a series of disconnections must first be completed. Such disconnections include the disengagement of a number of conventional press components such as counterbalance cylinders 130 and 131, and the removable brackets 132 by which the counterbalance cylinders 130 are attached and nut 131*a* by which counterbalance cylinder 131 is attached. The overall procedure is initiated by, lowering through the inching device, the slides to bottom dead center then disconnecting the adjusting screws from the adjusting nuts by rotating the adjusting nuts such that the inner slide 50 and blankholder 52 are disconnected from the crossheads 30, 30', 32 and 32'. This disconnection allows the slides to be lowered, by jacks, into contact with the stands or beams 81, disposed upon the carrier 80. Before the slides have come to rest upon the stands 81, counterbalance cylinders 130 and 131 are disengaged. It should be appreciated that other press components not featured in the drawings will also require disconnection. Finally, guides 58 and 112 and their associated parts and brackets 132 and nut 131*a* are removed as shown in FIGS. 4 and 7, thereby completely disengaging the outer slide 52 and inner slide 50 from the press 10 for transverse removal through side opening 44, as shown in FIG. 7.

Figure 10:
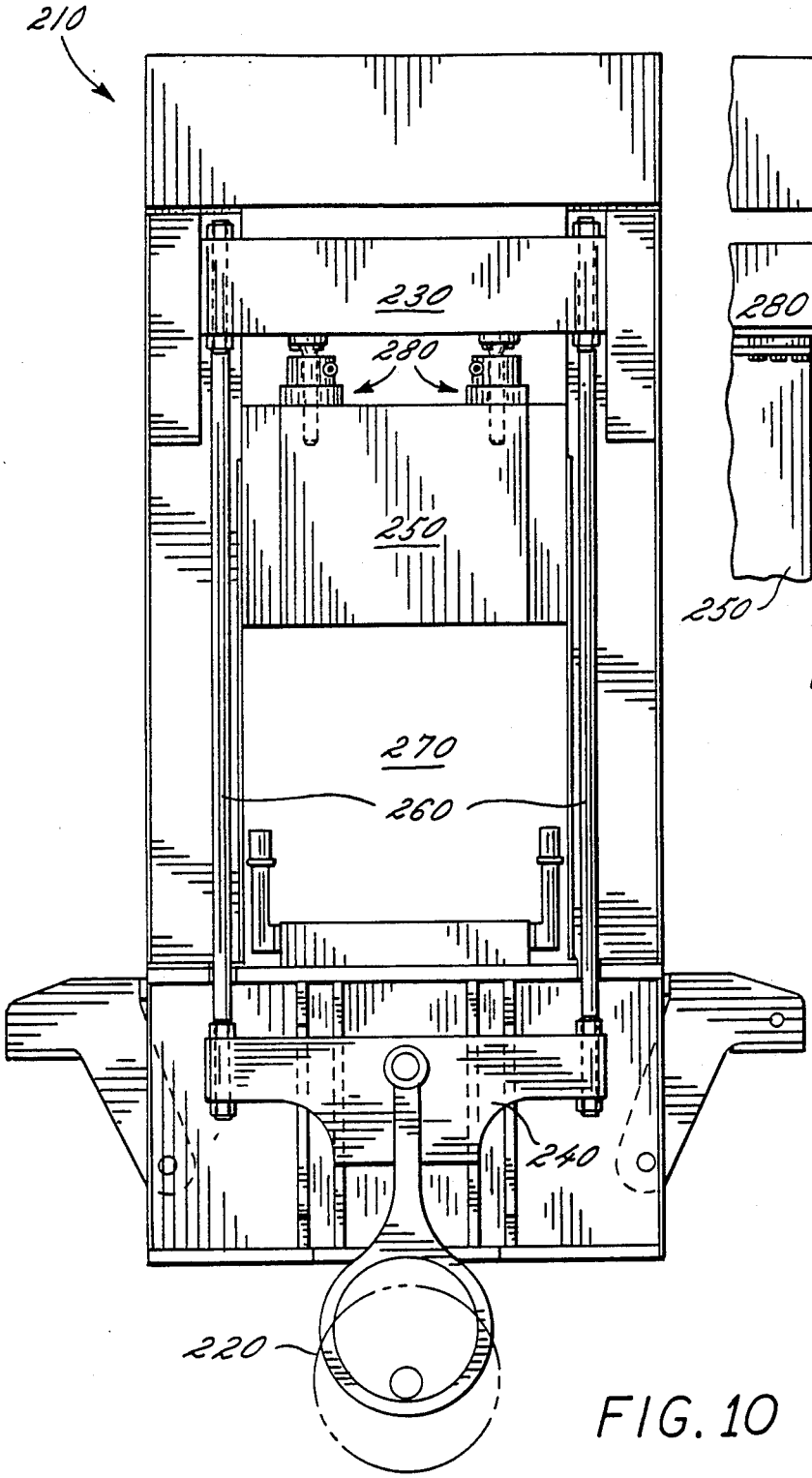
FIG. 10 is a side view of a transfer feed press in accordance with the present invention showing a slide mechanism which is transversely removable through the uprights thereof.

Finally, as depicted in FIG. 10, the present invention is adaptable for use in a transfer feed press. Transfer feed presses are single presses utilizing one or more rams that are particularly suited to perform within a single press all of the functions performed in an automatic press line. Where, in an automatic press line, each individual press performs a single deformation function such that the workpiece is gradually formed into its desired shape as it is conveyed through the press line, a transfer press performs the same functions within a single press by transfering the part from die station to die station. Typically, transfer feed presses are single action, and as disclosed herein, can be of the underdrive variety. A standard transfer feed press is disclosed in FIG. 10, and is generally indicated at 210. As shown in the drawings, the press is powered by conventional drive means 220 disposed in areas substantially beneath the press room floor. In order to impart reciprocal motion to the slide 250, upper crossheads 230 and 230' (not shown), and lower crossheads, 240 and 240' (not shown), are provided, the crossheads being interconnected by pull rods 260. The crossheads 230 and 240 have been designed such that their width is greater than the corresponding width dimension of the slide 250, thereby allowing for an upright opening 270 of sufficient width such that the slide 250 is transversely removable therethrough. Furthermore, since the pull rods are interconnected at the distal ends of the crossheads, the pull rods are thus disposed in an area within the press uprights, and accordingly, do not interfere with the slide 250 as it is removed from within the press.

Disposed between the upper crossheads 230 and 230' (not shown) and the slide 250 are adjustable slide connections 280, said slide connections displaying features similar to those of slide connections 110 previously discussed in this specification. These connections serve to removably attach the slide to the upper crosshead, and further provide means for adjusting the motion range of the slide. For purposes of slide removal, this adjustment mechanism allows the operator to gradually lower the slide into a removal position while also disconnecting the slide from the upper crossheads.

Figure 11:
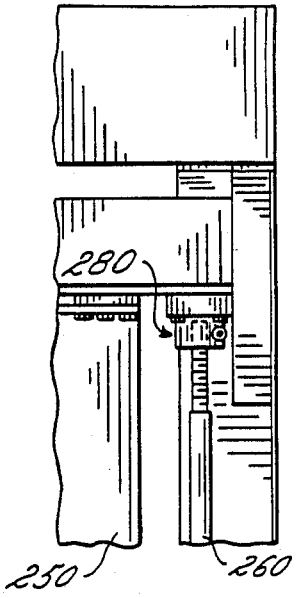
FIG. 11 is a side view of the right portion of the press of FIG. 10 showing an alternative embodiment thereof.

FIG. 11 shows an alternative embodiment of the press. In this embodiment, however, the slide 250 is removably attached directly to the crossheads and the adjustment mechanism is located at a distal end of the crosshead and is incorporated with the pull rods. Accordingly, the removal of the slide in this configuration requires unbolting the slide resting on jacks and then lowering into a removal position.

I claim as my invention:

1. In a power press assembly the combination comprising:

a main frame having a plurality of spaced apart opposing uprights and a crown, said main frame including four spaced apart opposing uprights, each of said uprights being disposed vertically with respect to said press bed, each of said uprights is a hollow column for supporting the press and through which said drive means extends, said uprights having a plurality of guide channels disposed thereon for guiding said movable crossheads through a predetermined range of motion and said plurality of guide channels are symmetrically disposed in paired arrangement upon the uprights and receive guide flange means on the respective movable crossheads;

a press bed disposed beneath and opposite said crown;

at least one pair of movable crossheads guided in and bridging the opening between said frame uprights above at least one slide mechanism;

drive means attached to said movable crossheads for reciprocating said slide mechanism toward and away from said press bed;

said slide mechanism being narrower than the crossheads and removably coupled to said movable crossheads.

2. A power press assembly as claimed in claim 1 wherein opposed pairs of said uprights are disposed so as to form alligned openings, said openings being adapted to accommodate the entry and exit of a workpiece from the press.

3. A power press assembly as claimed in claim 2 wherein at least a pair of said spaced columns define openings of predetermined height and width dimensions, said dimensions being relatively larger than the width and height dimensions of the slide mechanism so as to allow for the removal of the slide mechanism through one of the openings of the press frame.

4. A power press assembly as claimed in claim 1 wherein each of said movable crossheads includes:

a body section of such length so as to span the distance between a pair of guide columns disposed upon the spaced apart uprights;

a plurality of guide flanges disposed upon said body section for slidable movement with respect to said guide columns;

at least one mounting means for removably coupling said slide mechanism to said crosshead;

at least one engagement cavity disposed within said body section into which said drive means extends; and a pair of means for pivotally connecting said drive means to said crosshead, said pivotally connecting means extending through the body section and through an area described by said at least one engagement cavity.

5. A power press assembly as claimed in claim 4 wherein said body section is of welded construction.

6. A power press assembly as claimed in claim 4 wherein said at least one mounting means is disposed on a bottom surface of said crosshead and includes a plurality of threaded bores for receiving a corresponding plurality of threaded fasteners for removably coupling said slide mechanism to said crosshead.

7. A power press assembly as claimed in claim 1 wherein said slide mechanism includes:

at least one slide body for deforming a workpiece; and a frame extension extending transversely from said slide body in a direction toward each of said movable crossheads, said frame extension spanning the distance between said slide body and said movable crosshead for connection therewith.

8. A power press assembly as claimed in claim 1 wherein said power press is a double action press having two slide bodies, said bodies including:

a blankholder slide for retaining a workpiece in a desired location; and an inner slide for deforming said workpiece.

9. A power press assembly as claimed in claim 7 wherein said power press is a double action press having two slide bodies, said bodies including:

a blankholder slide for retaining a workpiece in a desired location; and an inner drawing slide for deforming said workpiece and said movable crossheads include inner and outer crossheads for respective ones of the slides.

10. A power press assembly as claimed in claim 9 wherein:

said blankholder slide spans the distance between the inner movable crossheads; and frame and frame extensions of said drawing slide extend between the outer movable crossheads, said frame and frame extensions of said drawing slide being of greater length than the blankholder slide such that each slide is independently removable from its respective crosshead.

11. In a power press assembly the combination comprising:

a main frame having a plurality of spaced apart opposing uprights and a crown;

a press bed disposed beneath and opposite said crown;

at least one pair of movable crossheads guided in and bridging the opening between said frame uprights above at least one slide mechanism, said slide mechanism bolted to said movable crossheads so as to form an integral slide assembly;

drive means attached to said movable crossheads for reciprocating said slide mechanism toward and away from said press bed;

said slide mechanism being narrower than the crossheads and removably coupled to said movable crossheads so as to be removable transversely through said spaced apart uprights; and an adjustment connection disposed between said movable crossheads and a plurality of pull rods and said slide mechanism can be separately disconnected from said crossheads.

12. In a power press assembly the combination comprising:

a main frame having a plurality of spaced apart opposing uprights and a crown, a press bed disposed beneath and opposite said crown;

at least one pair of movable crossheads guided in and bridging the opening between said frame uprights above at least one slide mechanism, each of said movable crossheads including a body section of such length so as to span the distance between a pair of guide columns disposed upon the spaced apart uprights, a plurality of guide flanges disposed upon said body section for slidable movement with respect to said guide columns, at least one mounting means for removably coupling said slide mechanism to said crosshead disposed on a bottom surface of said crosshead and including a plurality of threaded bores for receiving a corresponding plurality of threaded fasteners for removable coupling said slide mechanism to said crosshead, at least one engagement cavity disposed within said body section into which said drive means extends and a pair of means for pivotally connecting said drive means to said crosshead, said pivotally connecting means extending through the body section and through an area described by said at least one engagement cavity;

drive means attached to said movable crossheads for reciprocating said slide mechanism toward and away from said press bed;

said slide mechanism being narrower than the crossheads and removably coupled to said movable crossheads.

13. In a power press assembly the combination comprising:

a main frame having a plurality of spaced apart opposing uprights and a crown;

a press bed disposed beneath and opposite said crown;

at least one pair of movable crossheads guided in and bridging the opening between said frame uprights above at least one slide mechanism, said slide mechanism including at least one slide body for deforming a workpiece and a frame extension extending transversely from said slide body in a direction toward each of said movable crossheads, said frame extension spanning the distance between said slide body and said movable crosshead for connection therewith;

drive means attached to said movable crossheads for reciprocating said slide mechanism toward and away from said press bed;

said slide mechanism being narrower than the crossheads and removably coupled to said movable crossheads.

14. In a double action power press assembly having two slide bodies, the combination comprising:

a main frame having a plurality of spaced apart opposing uprights and a crown;

a press bed disposed beneath and opposite said crown;

at least one pair of movable crossheads guided in and bridging the opening between said frame uprights above at least one slide mechanism;

drive means attached to said movable crossheads for reciprocating said slide mechanism toward and away from said press bed;

said slide mechanism being narrower than the crossheads and removably coupled to said movable crossheads; and each slide body including a blankholder slide for retaining a workpiece in a desired location and an inner slide for deforming said workpiece.

* * * * *